US006536348B1

(12) United States Patent
Gral

(10) Patent No.: US 6,536,348 B1
(45) Date of Patent: Mar. 25, 2003

(54) DEVICE FOR ALTERING THE APPEARANCE OF VALUABLE ARTICLES AND CONTAINER COMPRISING SAME

(75) Inventor: René Gral, La Garenne Colombes (FR)

(73) Assignee: Val'Protect S.A., Courbevoie (FR)

( * ) Notice: Subject to any disclaimer, the term of this patent is extended or adjusted under 35 U.S.C. 154(b) by 0 days.

(21) Appl. No.: 09/445,731

(22) PCT Filed: Jun. 11, 1998

(86) PCT No.: PCT/FR98/01214

§ 371 (c)(1),
(2), (4) Date: Feb. 7, 2001

(87) PCT Pub. No.: WO98/57021

PCT Pub. Date: Dec. 17, 1998

(Under 37 CFR 1.47)

(30) Foreign Application Priority Data

Jun. 11, 1997 (FR) ..... 97 07251

(51) Int. Cl.[7] ..... E05G 1/14

(52) U.S. Cl. ..... 102/293; 86/50; 109/25; 109/26; 109/29; 109/36

(58) Field of Search ..... 102/293; 109/25, 109/27, 26, 29, 32, 33, 34, 36, 37; 86/50; 190/101

(56) References Cited

U.S. PATENT DOCUMENTS

| | | | | | |
|---|---|---|---|---|---|
| 1,606,258 | A | * | 11/1926 | Morssen | 109/25 |
| 1,646,687 | A | | 10/1927 | Daly | |
| 3,344,757 | A | * | 10/1967 | Touyet | 109/25 |
| 3,564,525 | A | * | 2/1971 | Robeson et al. | 42/1.13 |
| 3,703,780 | A | * | 11/1972 | King | 42/1.13 |
| 4,203,050 | A | * | 5/1980 | Rech et al. | 313/220 |
| 4,799,435 | A | * | 1/1989 | Boutroy | 109/25 |
| 4,852,502 | A | * | 8/1989 | Klingberg et al. | 109/25 |
| 4,884,507 | A | * | 12/1989 | Levy | 102/293 |

FOREIGN PATENT DOCUMENTS

| | | | | |
|---|---|---|---|---|
| DE | 30 25 853 | | 1/1981 | |
| EP | 0 188 155 | | 7/1986 | |
| FR | 976 235 | | 3/1951 | |
| GB | 787510 | * | 12/1957 | 109/25 |
| GB | 1 446 711 | | 8/1976 | |
| WO | WO 91/17681 | | 11/1991 | |
| WO | WO 95/28542 | | 10/1995 | |
| WO | WO 98/01646 | | 1/1998 | |

OTHER PUBLICATIONS

"The Condensed Chemical Dictionary" by Hawley. Van Nostrand Reinhold Company. 1971.*

* cited by examiner

*Primary Examiner*—Harold J. Tudor
(74) *Attorney, Agent, or Firm*—Young & Thompson

(57) ABSTRACT

The invention concerns a device for altering the appearance of valuable articles comprising at least a reservoir (22) filled with a fluid adapted to soil said articles and a pyrotechnic charge (24) associated with said reservoir (22) for opening the latter to release said fluid on said articles. The (each) reservoir (22) is substantially defined by a wall made of a fragmentation material adapted, by the effect of the pyrotechnic charge (24), to produce a multitude of scattered elementary splinters. The invention is applicable to suitcases for the transport of funds.

8 Claims, 2 Drawing Sheets

DEVICE FOR ALTERING THE APPEARANCE OF VALUABLE ARTICLES AND CONTAINER COMPRISING SAME

FIELD OF THE INVENTION

The present invention relates to a device for denaturing articles of value of the type comprising at least one reservoir filled with a fluid designed to soil the said articles and a pyrotechnic charge associated with the said reservoir for opening the latter with a view to releasing the said fluid over the said articles.

BACKGROUND OF THE INVENTION

A device of this kind is described in document EP-B-0, 188,155.

This device is used in a container for transporting valuables such as banknotes. It comprises a deformable reservoir filled with ink and equipped with a longitudinal line of weakness. A pyrotechnic cord is placed along this line of weakness. Furthermore, a metallic casing of triangular section is inserted between the pyrotechnic cord and the line of weakness.

When the pyrotechnic cord is ignited, this cord throws the metallic casing on to the line of weakness, which breaks. Under the action of the reverberation of the shock wave against the deformable wall of the reservoir in which vibration occurs, the ink contained in this reservoir is ejected through the opening formed along the line of weakness.

After the device has been triggered, and when most of the ink has been thrown over the articles to be denatured, the reservoir is still in one piece, only the longitudinal line of weakness having been broken to form an opening through which the ink is released.

The effectiveness of such a device is unsatisfactory and the use of a cutting cord is not always sufficient to open any paper envelope or metal wrapper in which the articles to be denatured may be contained. Furthermore, as the ink is thrown over the articles only after the shock wave has reverberated and bounced back from the part of the reservoir opposite its opening, the ink thrown out has a low speed, which means that its dispersion throughout the container is poor.

SUMMARY OF THE INVENTION

The object of the invention is to provide a solution to the problem mentioned earlier, and in particular to provide a device for denaturing articles which is effective irrespective of the distribution of the articles in the container, even if these articles are wrapped.

To this end, the subject of the invention is a device for denaturing articles of value of the aforementioned type, characterized in that the or each reservoir is essentially delimited by a wall made of a material which fragments in an appropriate way so that, under the action of the pyrotechnic charge, a multitude of disjointed elemental fragments is produced.

According to particular embodiments, the device may have one or more of the following features:

the said fragmentation material is a borosilicate glass;

the said material is a hardened glass;

the pyrotechnic charge is a detonating cutting cord;

the or each reservoir and the pyrotechnic charge are placed side by side in a deflector that diverges towards its outlet opening, which opening is intended to face towards the said articles;

the or each reservoir has an elongate shape and the pyrotechnic charge extends along the length of the reservoir on the outside of this reservoir;

the deflector has the shape of a channel and is delimited by two side walls that diverge towards the outlet opening and extend along the length of the or of each reservoir;

the pyrotechnic charge is placed inside the reservoir; and the reservoir has an elongate shape and the pyrotechnic charge extends over most of the length of the reservoir.

Another subject of the invention is a container comprising a chamber for protecting articles of value and a device for denaturing the valuables, which is connected to a triggering unit, characterized in that the denaturing device is a device as defined hereinabove.

BRIEF DESCRIPTION OF THE DRAWINGS

The invention will be better understood from reading the description which will follow, given merely by way of example and made with reference to the drawings in which.

DETAILED DESCRIPTION OF THE INVENTION

Figure 1:
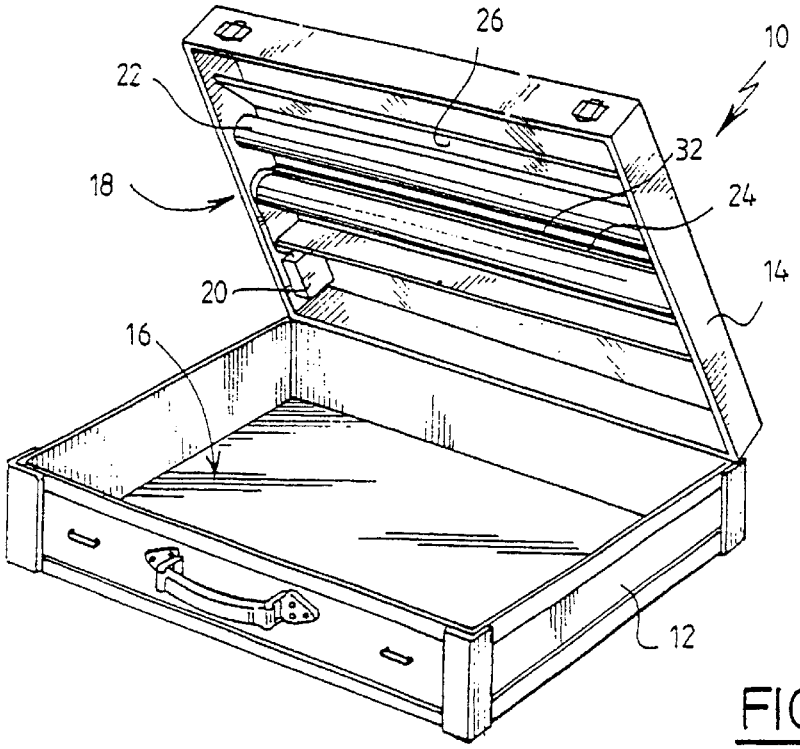
FIG. 1 is a view in perspective of an open suitcase for transporting monies, comprising a denaturing device according to the invention.

The suitcase 10 depicted in FIG. 1 comprises two half-shells 12, 14 articulated together. This suitcase forms a security container delimiting a chambers 16 for receiving articles of value to be transported such as banknotes, computer data media, or electronic components.

The chamber 16 is equipped with an opening in its upper part. This access opening can be blocked by the upper half-shell 14 that forms a lid.

Fixed along the entire length of the interior face of the lid 14 is a device 18 for denaturing the articles contained in the suitcase. This device is connected to a triggering unit 20. The latter is designed to fire the pyrotechnic means of the denaturing device in response to a predetermined item of information, in particular an attempted break-in, detected by a sensor borne by the suitcase. This triggering unit comprises, for example, a detonator, ref 4301, from the company Davey Bickford.

Figure 2:
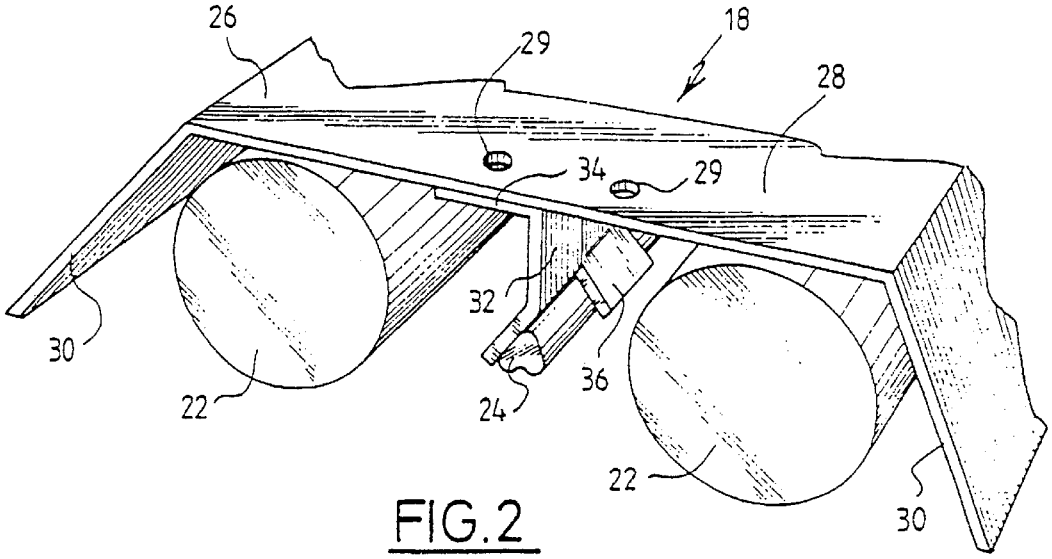
FIG. 2 is a part view in perspective of the denaturing device of FIG. 1.

As depicted in FIG. 2, the device 18 comprises two identical rigid reservoirs 22 in the shape of cylinders of revolution containing a fluid designed to soil the articles contained in the suitcase. The fluid is, for example, indelible ink.

The device further comprises a single pyrotechnic charge 24 formed by a detonating cutting cord, for example of the type HA 54 05.01 marketed in France by the company PYROMECA. This cord has a triangular cross-section, the length of one side being 4 or 5 mm.

According to the invention, the wall delimiting the reservoirs 22 is made essentially of a material that fragments and which, under the action of the pyrotechnic charge, is smashed into a multitude of disjointed elemental fragments more or less the same as each other.

The reservoirs are thus formed, for example, from ampoules made of borosilicate glass, or of a hardened glass.

The reservoirs 22 and the pyrotechnic charge 24 are supported by a deflector 26 extending along the entire length of the lid 14 and having the overall shape of a channel.

The deflector is delimited by a bottom 28 equipped with slots 29 for the passage of screws for attaching to the interior face of the lid, and by two side walls 30 which diverge towards the outlet opening of the deflector. This opening faces towards the inside of the suitcase when the suitcase is closed, and in particular faces towards the articles contained therein. The internal angle formed by the side walls 30 with the bottom 28 is, for example, approximately 120°.

Fixed along the longitudinal mid-plane of the deflector is a middle wall 32 supporting the detonating cutting cord 24. The reservoirs 22 are thus placed in the two compartments delimited in the deflector on each side of the wall 32. They are held slightly away from the bottom 28 and from the side walls 30.

The wall 32 comprises a stand 34, formed by a portion bent at right angles and welded to the bottom 28 of the deflector. The free edge of the middle wall 32 has uniformly spaced cuts which delimit tabs 36. These tabs are deformed alternately towards one then the other of the two reservoirs 22.

As depicted in FIG. 2, the detonating cord 24 is trapped and held by bonding between the deformed tabs 36. It thus simultaneously faces both reservoirs along successive portions separated by the tabs 36.

It will be understood that with such an arrangement, when the pyrotechnic charge 24 is fired, the explosion produced smashes the two reservoirs 22 in such a way that, under the effect of the blast, the numerous fragments produced are thrown towards the articles contained in the suitcase. In particular, they are guided by the deflector 26. Under the effect of the shock of the fragments, any wrapper that may surround the articles becomes torn. The ink contained in the reservoirs is simultaneously propelled by the effect of the blast and is thus thrown over the articles whose cover has been lacerated by the fragments of the reservoir.

The direct action of the blast both on the fragments from the wall of the reservoirs and on the fluid allows the fragments and the fluid to be thrown at high speed over the articles. Furthermore, the presence of the deflector guides the fragments and the fluid directly towards the articles so that their dispersion is low.

The use of a detonating cutting cord advantageously produces a direct effect of lacerating the articles in the region where the cord is attached.

Figure 3:
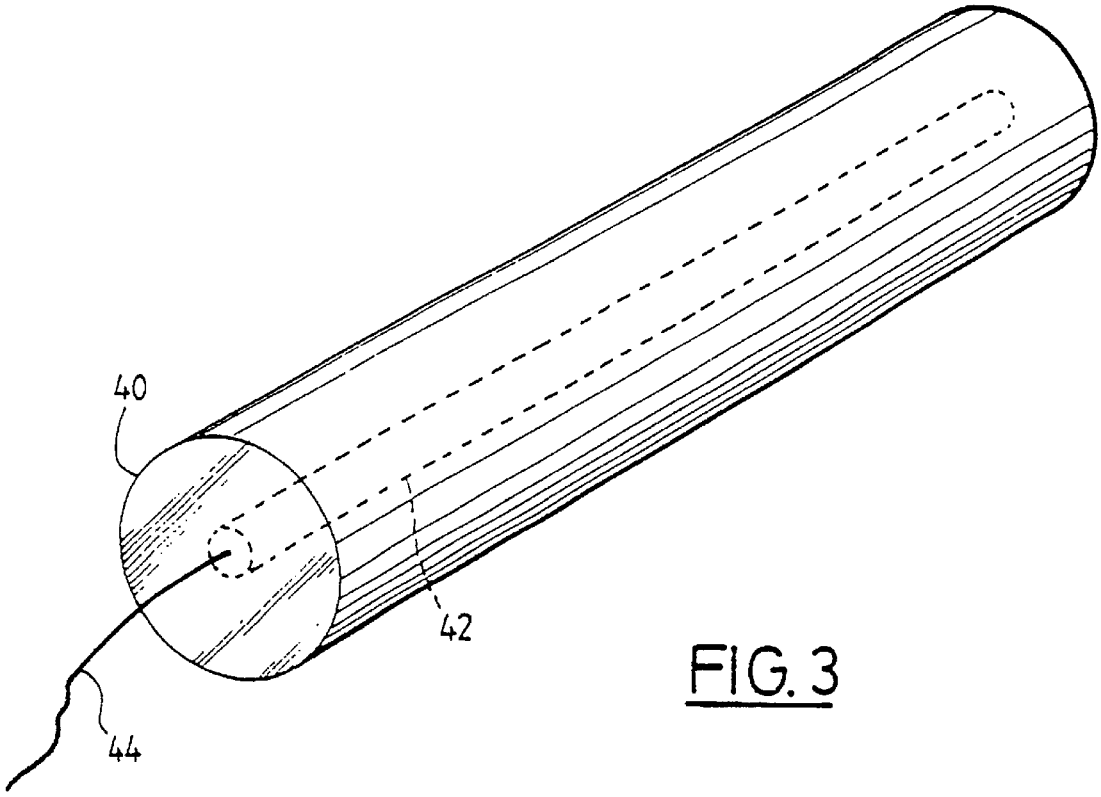
FIG. 3 is a view in perspective of an alternative form of the denaturing device according to the invention.

FIG. 3 depicts another alternative form of a denaturing device according to the invention.

This device comprises a cylindrical reservoir 40 formed by a glass ampoule. The wall of the ampoule is made of a material that fragments, such as borosilicate glass or hardened glass. This reservoir is filled with indelible ink or some other fluid intended to soil the articles. A pyrotechnic charge 42 placed directly in contact with the ink and extending along the axis of the cylinder passes axially right through it. This charge is formed, for example, of a detonating cord consisting of an explosive charge surrounded by a lead sleeve with a total thickness of approximately 1.5 mm.

The charge 42 is connected by a fuze 44 provided at one of its ends, to a triggering unit.

It will be understood that as before, the firing of the pyrotechnic charge 42 smashes the reservoir 40 which fragments into a collection of elemental fragments which are thrown towards the articles to be denatured. At the same time, the ink contained in the reservoir is dispatched over the articles under the effect of the blast.

In an alternative form, not depicted, the pyrotechnic charge 42 is bonded directly along the tube 40 on the outside of this tube.

With such an arrangement, the articles can be arranged anyhow inside the container. This is because the explosion produces a blast which is applied to the reservoir directly. The structure of the wall of this reservoir thus, in addition to the ink, plays a part in denaturing the articles by a laceration effect.

What is claimed is:

1. Device for denaturing articles of value comprising at least one reservoir (22, 40) filled with a fluid designed to soil the said articles and a pyrotechnic charge (24, 42) associated with the said reservoir (22, 40) for opening the latter with a view to releasing the said fluid over the said articles, characterized in that the at least one reservoir (22, 40) is essentially delimited by a wall made of a material which fragments under the action of the pyrotechnic charge (24, 42), to produce a multitude of disjointed elemental fragments adapted to lacerate the articles, characterized in that the at least one reservoir (22) has an elongate shape and in that the pyrotechnic charge (24) extends along the length of the reservoir on the outside of this reservoir, and characterized in that the pyrotechnic charge is a detonating cord (24) trapped and held between tabs (36) that are deformed alternately on either side of the cord (24).

2. Denaturing device according to claim 1, characterized in that the said fragmentation material is a borosilicate glass.

3. Denaturing device according to claim 1, characterized in that the said material is a hardened glass.

4. Denaturing device according to claim 1, characterized in that the detonating cord is a detonating cutting cord (24).

5. Denaturing device according to claim 1, characterized in that the at least one reservoir (22) and the pyrotechnic charge (24) are placed side by side in a deflector (26) that diverges towards its outlet opening, which opening is intended to face towards the said articles.

6. Denaturing device according to claim 5, characterized in that the deflector (26) has the shape of a channel and is delimited by two side walls (30) that diverge towards the outlet opening and extend along the length of the at least one reservoir (22).

7. Denaturing device according to claim 1, characterized in that the pyrotechnic charge (42) extends over most of the length of the reservoir (40).

8. Container comprising a chamber (16) for protecting the articles and a device (18) for denaturing the articles, which is connected to a triggering unit (20), characterized in that the denaturing device (18) is a device according to claim 1.

* * * * *